US008997313B1

(12) United States Patent
Krajenke et al.

(10) Patent No.: US 8,997,313 B1
(45) Date of Patent: Apr. 7, 2015

(54) CONCENTRIC SPIRAL SPRING COUNTERBALANCE MECHANISM

(71) Applicant: GM Global Technology Operations LLC, Detroit, MI (US)

(72) Inventors: Gary W. Krajenke, Warren, MI (US); Houng Yue Chang, Canton, MI (US); Carol A. Feldmann, South Lyon, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 0 days.

(21) Appl. No.: 14/319,593

(22) Filed: Jun. 30, 2014

(51) Int. Cl.
*E05F 1/08* (2006.01)
*E05F 1/12* (2006.01)

(52) U.S. Cl.
CPC ..... *E05F 1/1215* (2013.01)

(58) Field of Classification Search
CPC ..... E05Y 2900/548; E05Y 2900/546; E05Y 2900/531; E05Y 2201/416; E05D 2005/067; E05F 1/1276; E05F 1/1284; E05F 1/1292; E05F 1/1033; E05F 5/022
USPC ..... 16/289, 286, 368, 366, 311, 369, 370, 16/287, 288, 277, 308, 306; 296/76, 296/146.11, 146.8
See application file for complete search history.

(56) References Cited

U.S. PATENT DOCUMENTS

| | | | | |
|---|---|---|---|---|
| 1,721,501 | A * | 7/1929 | McKee | 160/191 |
| 1,767,113 | A * | 6/1930 | Armstrong | 267/199 |
| 2,390,086 | A * | 12/1945 | Ferris | 49/206 |
| 2,602,955 | A * | 7/1952 | McFarlane | 16/294 |
| 2,692,098 | A * | 10/1954 | Schmued et al. | 244/104 R |
| 3,091,447 | A | 5/1963 | Donkin | |
| 3,239,700 | A * | 3/1966 | Antritter | 310/97 |
| 4,921,230 | A | 5/1990 | Thomsen | |
| 5,133,225 | A * | 7/1992 | Lundberg et al. | 74/560 |
| 5,235,725 | A * | 8/1993 | Rees | 16/298 |
| 5,243,738 | A | 9/1993 | Kiefer | |
| 5,294,097 | A | 3/1994 | Thomsen et al. | |
| 7,546,663 | B2 * | 6/2009 | Duffy | 16/306 |
| 2006/0230578 | A1 * | 10/2006 | Renke et al. | 16/289 |
| 2010/0127443 | A1 * | 5/2010 | Kuroda | 267/156 |
| 2013/0318745 | A1 * | 12/2013 | Krajenke et al. | 16/305 |

* cited by examiner

*Primary Examiner* — Chuck Mah
(74) *Attorney, Agent, or Firm* — Quinn Law Group, PLLC

(57) ABSTRACT

A counterbalance includes a first attachment strap, and an arbor rotatably supported by the first attachment strap. A second attachment strap is attached to the arbor, and is rotatable with the arbor about a winding axis. A spiral spring interconnects the first attachment strap and the second attachment strap. A spring support is attached to the second attachment strap. The spring support includes an annular wall that is disposed circumferentially about and concentric with the winding axis. The annular wall is radially positioned relative to the winding axis to contact an outermost coil of spiral spring, to position the spiral spring in a spiral orientation about the winding axis, such that each coil of the spiral spring moves away from the winding axis with a substantially constant angular velocity to provide a substantially equal radial spacing between adjacent coils of the spiral spring.

15 Claims, 3 Drawing Sheets

CONCENTRIC SPIRAL SPRING COUNTERBALANCE MECHANISM

TECHNICAL FIELD

The invention generally relates to a counterbalance mechanism, and more specifically to a counterbalance mechanism having a spiral spring positioned concentrically about a winding axis.

BACKGROUND

Counterbalance mechanisms are often used to bias a first component relative to a second component. For example, a vehicle may include a counterbalance mechanism for biasing a hood or a truck deck lid relative to a vehicle structure. The counterbalance mechanisms provide a biasing force which helps or assists in moving the first component relative to the second component. The biasing force from the counterbalance mechanism reduces the force that a user must apply to lift or move the first component relative to the second component.

Counterbalance mechanisms typically include a spring, which is used to provide the biasing force of the counterbalance mechanism. One type of spring used in counterbalance mechanisms is a spiral spring. A spiral spring may alternatively be referred to as a clock spring. Spiral springs include a flat strip of spring steel that is coiled up around an axis in a shape of an Archimedean spiral to define the plurality of coils. An Archimedean spiral may be defined as the locus of points corresponding to the locations over time of a point moving away from a fixed point with a constant speed along a line which rotates with constant angular velocity about a center.

When spiral springs are loaded, i.e., wound, the coils urged to one side of the winding axis, disposing the spiral spring in eccentric position about the winding axis. When disposed in the eccentric position, one or more of the coils contact the adjacent coils on one side of the widening axis, thereby introducing a friction force between the contacting coils of the spiral spring. The friction force caused by the contacting coils reduces the efficiency of the spiral spring.

SUMMARY

A counterbalance mechanism is provided. The counterbalance mechanism includes a first attachment strap, and an arbor rotatably supported by the first attachment strap. The arbor is rotatable about a winding axis. A second attachment strap is attached to the arbor, and is rotatable with the arbor about the winding axis. A spiral spring interconnects the first attachment strap and the second attachment strap, and includes a plurality of coils wound about the winding axis. The spiral spring is operable to bias the first attachment strap and the second attachment strap angularly relative to each other about the winding axis. A spring support is attached to the first attachment strap. The spring support includes an annular wall that is disposed circumferentially about and concentric with the winding axis. The annular wall is radially positioned relative to the winding axis to contact an outermost coil of the plurality of coils to position the spiral spring in a spiral orientation about the winding axis. The spiral orientation of the spiral spring positions each coil of the spiral spring so that each coil moves away from the winding axis with a substantially constant angular velocity to provide a substantially equal radial spacing between adjacent coils of the spiral spring.

Accordingly, the annular wall of the spring support surrounds an outer periphery of the spiral spring, and engages a radial outer surface of the outermost coil of the spiral spring to position the spiral spring in a concentric position. By positioning the spiral spring in the concentric orientation, the annular wall of the spring support prevents the coils of the spiral spring from contacting each other, thereby maintaining the efficiency of the spiral spring.

The above features and advantages and other features and advantages of the present invention are readily apparent from the following detailed description of the best modes for carrying out the invention when taken in connection with the accompanying drawings.

DETAILED DESCRIPTION

Those having ordinary skill in the art will recognize that terms such as "above," "below," "upward," "downward," "top," "bottom," etc., are used descriptively for the figures, and do not represent limitations on the scope of the invention, as defined by the appended claims. Furthermore, the invention may be described herein in terms of functional and/or logical block components and/or various processing steps. It should be realized that such block components may be comprised of any number of hardware, software, and/or firmware components configured to perform the specified functions.

Figure 1:
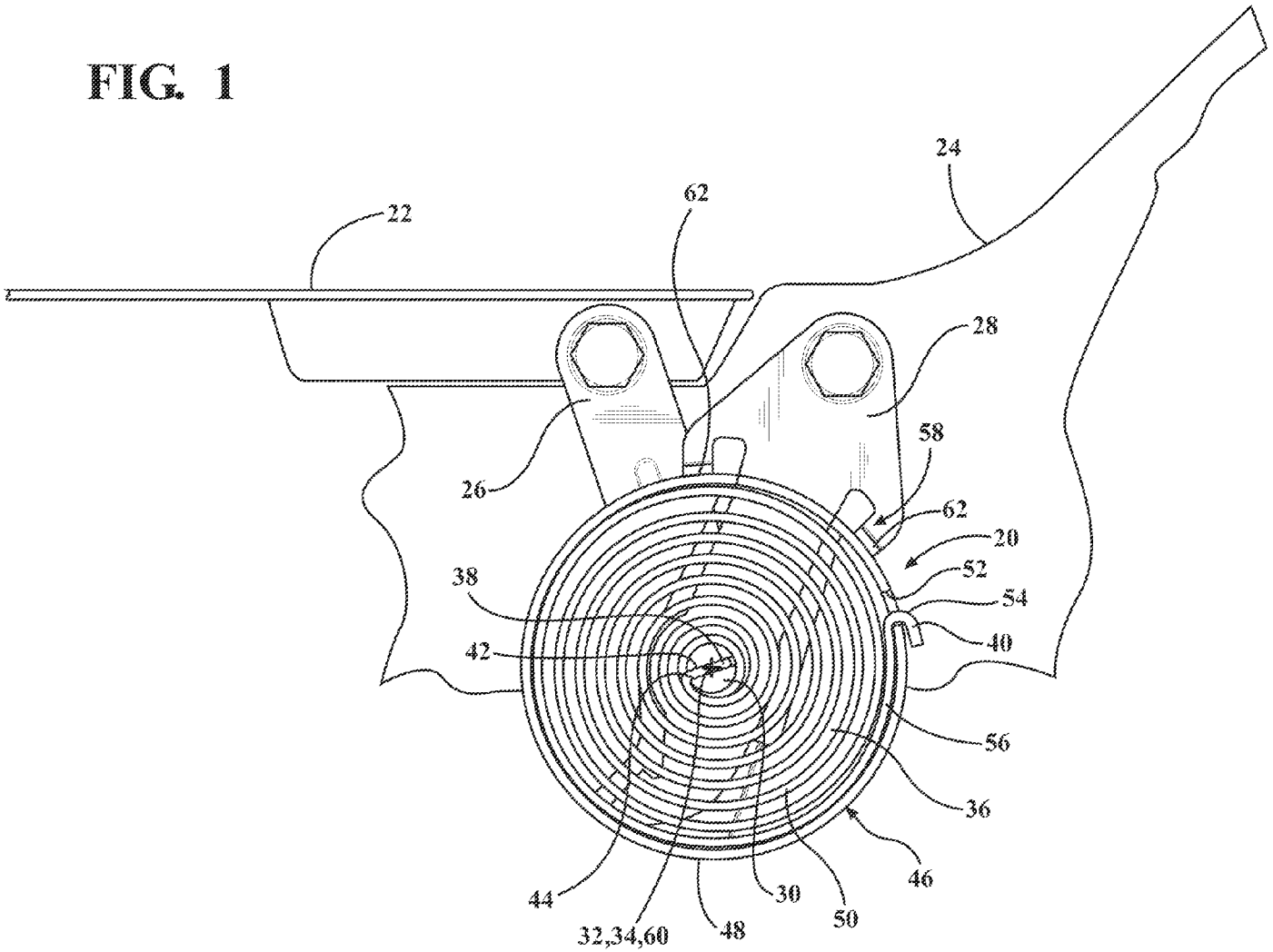
FIG. 1 is a schematic plan view from a side showing a counterbalance mechanism biasing a panel relative to a structure.
Figure 2:
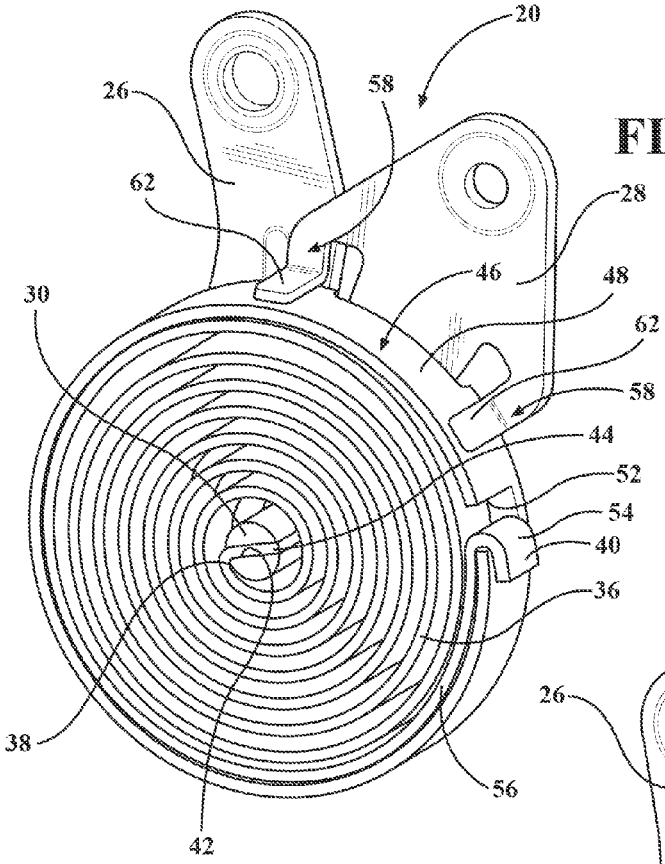
FIG. 2 is a schematic perspective view of the counterbalance mechanism.
Figure 3:
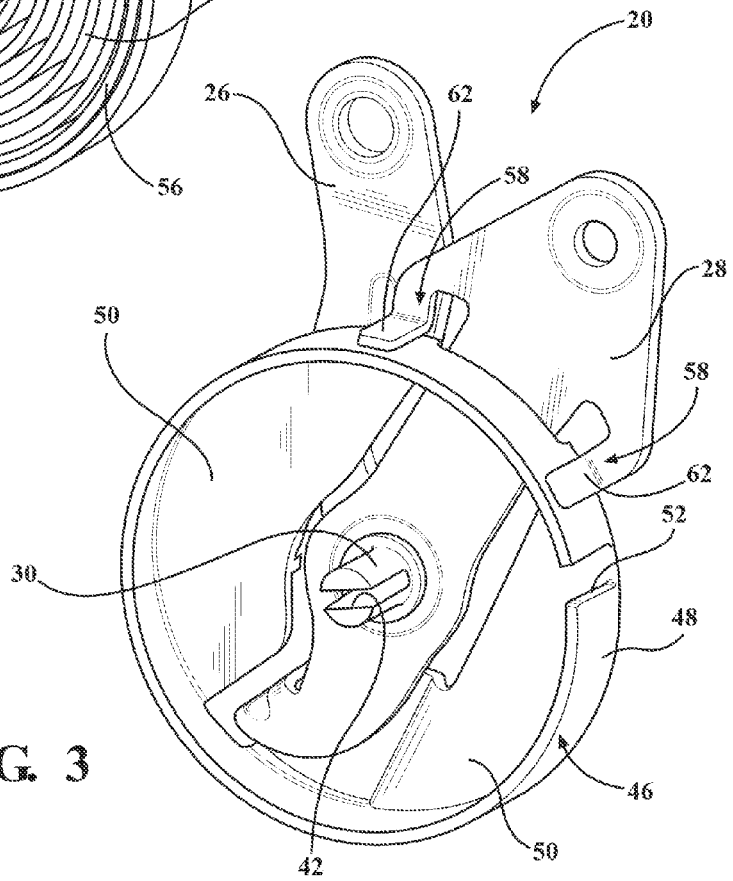
FIG. 3 is a schematic perspective view of the counterbalance mechanism without a spiral spring thereof.

Referring to the Figures, wherein like numerals indicate like parts throughout the several views, a counterbalance mechanism is generally shown at 20 in FIGS. 1 through 3. Referring to FIG. 1, the counterbalance mechanism 20 biases a first component 22 relative to a second component 24. The first component 22 may include, for example, a panel such as but not limited to a hood or truck deck lid of a vehicle. The second component 24 may include, for example, a structure of a vehicle. As such, the counterbalance mechanism 20 may be configured to bias the panel, i.e., the hood or trunk deck lid, relative to the vehicle structure, to assist in opening the panel.

Referring to FIGS. 1 through 3, the counterbalance mechanism 20 includes a first attachment strap 26 and a second attachment strap 28. The first attachment strap 26 is configured for attachment to the first component 22. The second attachment strap 28 is configured for attachment to the second component 24. As shown in FIG. 1, the first attachment strap 26 is attached to a panel, and the second attachment strap 28 is attached to a vehicle structure. However, it should be appreciated that the relative positions and attachments of the first attachment strap 26 and the second attachment strap 28 may be reversed, with the first attachment strap 26 attached to the vehicle structure, and the second attachment strap 28 attached to the panel.

An arbor 30 is attached to the first attachment strap 26. The arbor 30 is centered about and defines a winding axis 32. As such, the arbor 30 includes a central axis 34, which is coaxial with the winding axis 32. The second attachment strap 28 is rotatably supported by the arbor 30, and is rotatable relative to the arbor 30 and the first attachment strap 26 about the winding axis 32. While the counterbalance mechanism 20 is shown and described herein with the first attachment strap 26 attached to the arbor 30, and the second attachment strap 28 rotatable about the arbor 30, it should be appreciated that the relative positions of the first attachment strap 26 and the second attachment strap 28 may be reversed, with the second attachment strap 28 attached to the arbor 30, and the first attachment strap 26 rotatable about the arbor 30.

As shown in FIGS. 1 and 2, a spiral spring 36 interconnects the first attachment strap 26 and the second attachment strap 28. The spiral spring 36 biases the first attachment strap 26 and the second attachment strap 28 angularly relative to each other about the winding axis 32. The spiral spring 36 includes a flat strip of spring steel coiled up around the winding axis 32 in a shape of an Archimedes spiral to define a plurality of coils. As is generally understood, an Archimedean spiral is defined as the locus of points corresponding to the locations over time of a point moving away from a fixed point (or axis) with a constant speed along a line which rotates with constant angular velocity about the fixed point.

Referring to FIGS. 1 and 2, the spiral spring 36 includes an inner spring end 38 and an outer spring end 40. The inner spring end 38 is attached to the arbor 30. The arbor 30 defines a slot 42, and the inner spring end 38 of the spiral spring 36 defines an inner hook 44. The inner hook 44 extends through the slot 42 and engages the arbor 30 to secure the inner spring end 38 of the spiral spring 36 to the arbor 30.

Referring to FIGS. 1 through 3, a spring support 46 is fixedly attached to the second attachment strap 28, such that the arbor 30 winds the spiral spring 36 as the second attachment strap 28 and the arbor 30 rotate about the winding axis 32 relative to the first attachment strap 26. The spring support 46 includes an annular wall 48 disposed circumferentially about and concentric with the winding axis 32, and a bottom wall 50 disposed substantially perpendicular relative to the winding axis 32. The annular wall 48 extends substantially perpendicular relative to the bottom wall 50, along and parallel with the winding axis 32.

As shown in FIGS. 1 and 2, the outer spring end 40 is attached to the annular wall 48 of the spring support 46. The annular wall 48 defines a window 52, and the outer spring end 40 of the spiral spring 36 defines an outer hook 54. The outer hook 54 extends through the window 52 and engages the annular wall 48 to secure the outer spring end 40 of the spiral spring 36 to the annular wall 48 of the spring support 46.

Referring to FIGS. 1 and 2, the annular wall 48 is radially positioned relative to the winding axis 32 to contact an outermost coil 56 of the spiral spring 36, when the spiral spring 36 is un-loaded, i.e., prior to the spiral spring 36 being loaded by rotation of the second attachment strap 28 and the arbor 30 relative to the first attachment strap 26.

The annular wall 48 contacts the outermost coil 56 of the spiral spring 36 to position the spiral spring 36 in a spiral orientation about the winding axis, such that each coil of the spiral spring moves away from the winding axis with a substantially constant angular velocity to provide a substantially equal radial spacing between adjacent coils of the spiral spring 26. The spiral orientation may alternatively be described as a substantially concentric orientation about the winding axis 32. When positioned in the spiral orientation (concentric orientation) prior to being loaded by rotation of the second attachment strap 28 and the arbor 30 about the winding axis 32, each coil of the spiral spring 36 is substantially concentric or symmetric with respect to the other coils of the spiral spring 36 and the winding axis 32, to provide a substantially equal radial spacing between adjacent coils of the spiral spring 36, thereby ensuring that adjacent coils do not contact each other.

The second attachment strap 28 may include a positioning mechanism 58 that is operable to position the annular wall 48 of the spring support 46 relative to the second attachment strap 28, such that a central axis 60 of the annular wall 48 is co-axial with the winding axis 32. The positioning mechanism 58 may include, for example, at least two tabs 62 formed by the second attachment strap 28 and positioned to contact the annular wall 48 of the spring support 46 when the spring support 46 is positioned with the central axis 60 of the annular wall 48 co-axial with the winding axis 32. The two tabs 62 of the second attachment strap 28 are angularly spaced from each other about the winding axis 32, and are each spaced from the winding axis 32 a radial distance. Accordingly, during assembly, the spring support 46 may be positioned against the second attachment strap 28 such that the annular wall 48 contacts both of the alignment tabs 62 of the positioning mechanism 58. When the spring support 46 is in contact with both of the alignment tabs 62, the central axis 60 of the annular wall 48 is positioned substantially coaxial with the winding axis 32, so that the annular wall 48 will position the spiral spring 36 in the spiral orientation. Once positioned, the spring support 46 may be attached to the second attachment strap 28 in any suitable manner, such as by welding or with mechanical fasteners.

Preferably, the spring support 46 is supported by and contacts the second attachment strap 28 in at least three different locations that are radially spaced from the winding axis 32, and angularly spaced from each other about the winding axis 32. Attaching the spring support 46 to the second attachment strap 28 at three different locations provides a strong and stable attachment to the second attachment strap 28 to prevent the spring support 46 from wobbling or bending relative to the second attachment strap 28. As shown, the spring support 46 contacts and is attached to the second attachment strap 28 at both of the alignment tabs 62 of the positioning mechanism 58. Additionally, the spring support 46 is preferably attached to the second attachment strap 28 at a third location. For example and as shown, the spring support 46 is attached to the second attachment strap 28 at a location substantially opposite the winding axis 32 from the two alignment tabs 62 of the positioning mechanism 58. Alternatively, it should be appreciated that the positioning mechanism 58 may include three tabs 62, with the spring support 46 attached to the positioning mechanism 58 at each of the three alignment tabs 62.

Figure 4:
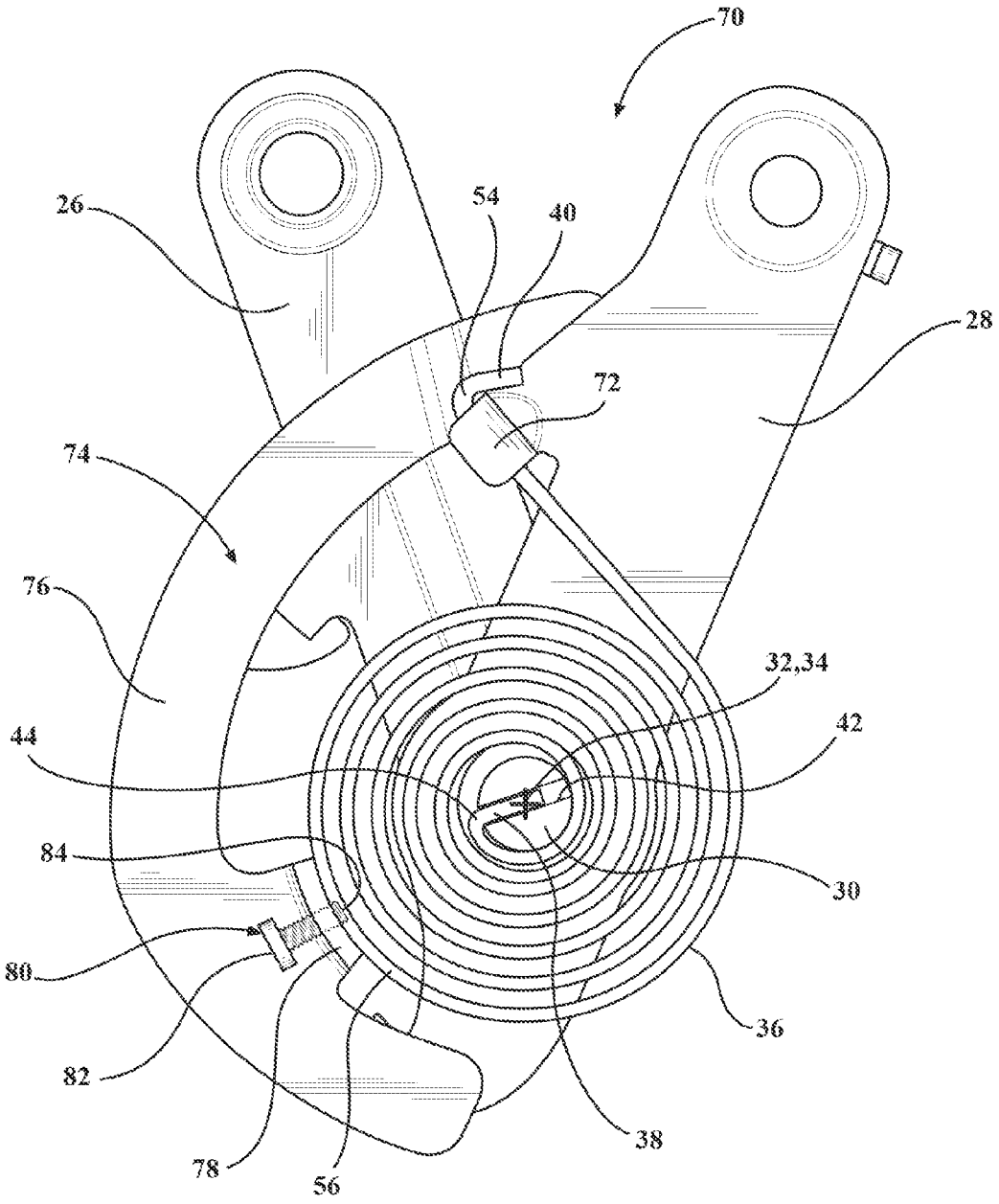
FIG. 4 is a schematic perspective view of an alternative embodiment of the counterbalance mechanism.

Referring to FIG. 4, an alternative embodiment of the counterbalance mechanism is generally shown at 70. Throughout FIG. 4, features of the counterbalance mechanism 70 that are similar to the features of the counterbalance mechanism 20 shown in FIGS. 1-3 are identified by the same reference numerals.

The counterbalance mechanism 70 includes a first attachment strap 26 and a second attachment strap 28. An arbor 30 is rotatably supported by the first attachment strap 26. The arbor 30 is rotatable about a winding axis 32 relative to the first attachment strap 26. The arbor 30 is centered about and defines the winding axis 32. As such, the arbor 30 includes a central axis 34, which is coaxial with the winding axis 32. The second attachment strap 28 is attached to the arbor 30, and is rotatable with the arbor 30 about the winding axis 32 relative to the first attachment strap 26.

A spiral spring 36 interconnects the first attachment strap 26 and the second attachment strap 28. The spiral spring 36 biases the first attachment strap 26 and the second attachment strap 28 angularly relative to each other about the winding axis 32. The spiral spring 36 includes an inner spring end 38 and an outer spring end 40. The inner spring end 38 is attached to the arbor 30. The arbor 30 defines a slot 42, and the inner spring end 38 of the spiral spring 36 defines an inner hook 44. The inner hook 44 extends through the slot 42 and engages the arbor 30 to secure the inner spring end 38 of the spiral spring 36 to the arbor 30. The outer spring end 40 is attached to the first attachment strap 26. The first attachment strap 26 includes an arm 72, and the outer spring end 40 of the spiral spring 36 defines an outer hook 54. The outer hook 54 extends over and grasps the arm 72 to secure the outer spring end 40 of the spiral spring 36 to the first attachment strap 26.

A spring support 74 is attached to the first attachment strap 26. The spring support 74 includes a planar portion 76, which is attached to the first attachment strap 26 in at least two different locations. The planar portion 76 is disposed substantially perpendicular to the winding axis 32. The spring support 74 includes a wall 78 that extends substantially perpendicular from the planar portion 76, along the winding axis 32. The wall 78 is radially spaced from the winding axis 32.

The wall 78 of the spring support 74 supports an adjustment screw 80. The adjustment screw 80 is disposed in threaded engagement with the wall 78. The adjustment screw 80 includes a head 82 disposed on a radially outer side of the wall 78 relative to the winding axis 32, and presents a screw end 84 through a radially inner side of the wall 78 relative to the winding axis 32. The screw end 84 of the adjustment screw 80 is disposed in contact with an outermost coil 56 of the spiral spring 36.

The adjustment screw 80 is adjustable inward toward and outward away from the winding axis 32 by threading the adjustment screw 80 into or out of the wall 78 of the spring support 74. Moving the adjustment screw 80 adjusts a radial distance between the screw end 84 of the adjustment screw 80 and the winding axis 32, which changes the radial position of the outermost coil 56 of the spiral spring 36. By moving the adjustment screw 80, the spiral spring 36 may be positioned in the concentric orientation about the winding axis 32, when the spiral spring 36 is un-loaded, i.e., prior to the spiral spring 36 being loaded by rotation of the second attachment strap 28 and the arbor 30 relative to the first attachment strap 26. When positioned in the concentric orientation prior to being loaded by rotation of the second attachment strap 28 and the arbor 30 about the winding axis 32, each coil of the spiral spring 36 is substantially concentric with respect to the other coils of the spiral spring 36 and the winding axis 32, to provide a substantially equal radial spacing between adjacent coils of the spiral spring 36, thereby ensuring that adjacent coils do not contact each other.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A counterbalance mechanism comprising:

a first attachment strap;

an arbor attached to the first attachment strap;

a second attachment strap rotatably supported by the arbor and rotatable relative to the arbor about a winding axis;

a spiral spring interconnecting the first attachment strap and the second attachment strap, and including a plurality of coils wound about the winding axis, wherein the spiral spring is operable to bias the first attachment strap and the second attachment strap angularly relative to each other about the winding axis; and a spring support attached to the second attachment strap and including an annular wall disposed circumferentially about and concentric with the winding axis;

wherein the annular wall is radially positioned relative to the winding axis to contact an outermost coil of the plurality of coils to position the spiral spring in a spiral orientation about the winding axis;

wherein the second attachment strap includes a positioning mechanism operable to position the annular wall of the spring support relative to the second attachment strap such that a central axis of the annular wall is co-axial with the winding axis; and wherein the positioning mechanism includes at least two tabs formed by the second attachment strap and positioned to contact the annular wall of the spring support when the spring support is positioned with the central axis of the annular wall co-axial with the winding axis.

2. A counterbalance mechanism as set forth in claim 1 wherein the spiral spring includes an outer spring end attached to the annular wall of the spring support.

3. A counterbalance mechanism as set forth in claim 2 wherein the annular wall defines a window and the outer spring end of the spiral spring defines an outer hook, with the outer hook extending through the window and engaging the annular wall to secure the outer spring end of the spiral spring to the annular wall of the spring support.

4. A counterbalance mechanism as set forth in claim 2 wherein the spiral spring includes an inner spring end attached to the arbor.

5. A counterbalance mechanism as set forth in claim 4 wherein the arbor defines a slot, and the inner spring end of the spiral spring defines an inner hook, with the inner hook extending through the slot and engaging the arbor to secure the inner spring end of the spiral spring to the arbor.

6. A counterbalance mechanism as set forth in claim 1 wherein the at least two tabs are angularly spaced from each other about the winding axis, and wherein the at least two tabs are each spaced from the winding axis a radial distance.

7. A counterbalance mechanism as set forth in claim 1 wherein the spring support includes a bottom wall disposed substantially perpendicular relative to the winding axis, with the annular wall extending substantially perpendicular relative to the bottom wall along and parallel with the winding axis.

8. A counterbalance mechanism as set forth in claim 1 wherein the spring support is supported by and contacts the second attachment strap in at least three different locations.

9. A counterbalance mechanism as set forth in claim 1 wherein the arbor is centered about and defines the winding axis.

10. A counterbalance mechanism as set forth in claim 1 wherein the spiral spring includes a flat strip of spring steel coiled up around the winding axis in a shape of an Archimedes spiral to define the plurality of coils.

11. A counterbalance mechanism for biasing a panel relative to a structure, the counterbalance mechanism comprising:

a first attachment strap configured for attachment to a panel;

an arbor attached to the first attachment strap, wherein the arbor is centered about and defines a winding axis;

a second attachment strap rotatably supported by the arbor and rotatable relative to the arbor and the first attachment strap about the winding axis, wherein the second attachment strap is configured for attachment to a vehicle structure;

a spiral spring having a plurality of coils wound about the winding axis, and operable to bias the first attachment strap and the second attachment strap angularly relative to each other about the winding axis; and a spring support fixedly attached to the second attachment strap and including an annular wall disposed circumferentially about and concentric with the winding axis;

wherein the annular wall is radially positioned relative to the winding axis to contact an outermost coil of the spiral spring to position the spiral spring in a substantially concentric orientation about the winding axis;

wherein the spiral spring includes an inner spring end attached to the arbor, and an outer spring end attached to the annular wall of the spring support, such that the arbor winds the spiral spring as the second attachment strap and the arbor rotate about the winding axis relative to the first attachment strap;

wherein the second attachment strap includes a positioning mechanism operable to position the annular wall of the spring support relative to the second attachment strap such that a central axis of the annular wall is co-axial with the winding axis; and wherein the positioning mechanism includes at least two tabs formed by the second attachment strap and positioned to contact the annular wall of the spring support when the spring support is positioned with the central axis of the annular wall co-axial with the winding axis.

12. A counterbalance mechanism as set forth in claim 11 wherein the annular wall defines a window and the outer spring end of the spiral spring defines an outer hook, with the outer hook extending through the window and engaging the annular wall to secure the outer spring end of the spiral spring to the annular wall of the spring support.

13. A counterbalance mechanism as set forth in claim 11 wherein the arbor defines a slot and the inner spring end of the spiral spring defines an inner hook, with the inner hook extending through the slot and engaging the arbor to secure the inner spring end of the spiral spring to the arbor.

14. A counterbalance mechanism as set forth in claim 11 wherein the at least two tabs are angularly spaced from each other about the winding axis, and wherein the at least two tabs are each spaced from the winding axis a radial distance.

15. A counterbalance mechanism for biasing a panel relative to a structure, the counterbalance mechanism comprising:

a first attachment strap;

an arbor attached to the first attachment strap;

a second attachment strap rotatably supported by the arbor and rotatable relative to the arbor and the first attachment strap about a winding axis;

a spiral spring having a plurality of coils wound about the winding axis, and including an inner spring end attached to the arbor and an outer spring end coupled to the second attachment strap; and a spring support attached to the second attachment strap and including a wall radially spaced from the winding axis; and an adjustment screw in threaded engagement with the wall and presenting a screw end in contact with an outermost coil of the spiral spring;

wherein the adjustment screw is adjustable toward and away from the winding axis to adjust a radial distance between the screw end of the adjustment screw and the winding axis to position the spiral spring in a substantially spiral orientation about the winding axis.

* * * * *